United States Patent [19]

Raasch

[11] Patent Number: 4,920,739

[45] Date of Patent: May 1, 1990

[54] METHOD AND APPARATUS FOR REESTABLISHING THE SPINNING OPERATION

[75] Inventor: Hans Raasch, Mönchengladbach, Fed. Rep. of Germany

[73] Assignee: W. Schlafhorst & Co., Monchengladbach, Fed. Rep. of Germany

[21] Appl. No.: 300,954

[22] Filed: Jan. 23, 1989

[30] Foreign Application Priority Data

Jan. 23, 1988 [DE] Fed. Rep. of Germany ..... 3801964

[51] Int. Cl.[5] ..... D01H 15/02

[52] U.S. Cl. ..... 57/263

[58] Field of Search ..... 57/261, 263, 264, 266, 57/268, 269, 270, 271, 276; 242/18 EW, 35.5 R

[56] References Cited

U.S. PATENT DOCUMENTS

| | | | |
|---|---|---|---|
| 3,791,126 | 2/1974 | Kose et al. | 57/269 |
| 3,855,771 | 12/1974 | Yoshizawa et al. | 57/269 |
| 4,139,162 | 2/1979 | Stahlecker | 57/270 X |
| 4,175,370 | 11/1979 | Stahlecker | 57/263 |
| 4,539,803 | 9/1985 | Ferro | 57/270 X |
| 4,630,782 | 12/1986 | Rohner | 242/18 EW |
| 4,653,261 | 3/1987 | Schrieber et al. | 57/263 |
| 4,736,898 | 4/1988 | Raasch et al. | 242/18 EW |

*Primary Examiner*—Donald Watkins

*Attorney, Agent, or Firm*—Shefte, Pinckney & Sawyer

[57] ABSTRACT

A method and apparatus for reestablishing the spinning operation at a spinning station of an open end spinning machine after a yarn break or after completion of winding of a full package. A traveling piecing unit responds to signals at a spinning station that indicate that a yarn break has occurred, that a package changing operation has occurred, or that winding of a package has been completed. Independently, a traveling package changing unit responds to a signal indicating that winding of a package has been completed at a spinning station and performs the package changing operation. When the piecing unit responds to a yarn break at a spinning station, it locates and withdraws the end of broken yarn from the package and positions it in a position where the unit then feeds the end to the spinning element to piece it with new yarn being spun and then releases it to the package, which resumes winding. When the piecing unit operates to restart winding after a package changing operation, it positions an end of yarn from a package of auxiliary yarn and performs the same piecing operation as with an end from a yarn break and then feeds the yarn onto the positioned empty bobbin.

16 Claims, 5 Drawing Sheets

METHOD AND APPARATUS FOR REESTABLISHING THE SPINNING OPERATION

BACKGROUND OF THE INVENTION

The present invention relates to a method and apparatus for reestablishing the spinning operation of a spinning station of an open end spinning machine and more particularly for reestablishing spinning after either a yarn break or a package change.

Frameless service units are conventionally used for changing packages at spinning stations of spinning machines for empty tubes. One type of such unit performs the package change by severing the yarn being fed from the spinning element to the package being wound, retaining the continuously feeding yarn in a suction tube and changing the full package for an empty tube. Thereafter, the yarn that has been continuously drawn into the suction tube is transferred to the tube where, initially, a yarn reserve on an extension of the tube is built, and then the yarn is released for continuous spinning at the spinning station.

However, one disadvantage of this type of package change operation is that the yarn continues to feed from the spinning element while the package change unit, which serves a plurality of spinning stations, travels to the spinning station to carry out the package changing operation. Typically, the package changing unit is summoned to service a spinning station when the yarn being wound on the package thereat has reached a predetermined length or the package has reached a predetermined mass or a predetermined diameter. In order to build a package having a relatively precisely predetermined yarn length, the spinning operation must be immediately interrupted once the yarn length is reached, at which time the servicing unit may not be readily available.

Also known are combination package changing and yarn restarting units which, after performing a package changing operation, restart the spinning operation using an auxiliary yarn to provide a yarn end to feed to the spinning element. The newly spun yarn is pieced onto the auxiliary yarn and is drawn out of the spinning element by suction and transferred to the empty tube for building a package thereon.

However, the productivity using such a combination unit is relatively low because during the restoring of a spinning station to its spinning operation following a yarn break, the package change apparatus must necessarily remain idle and is, accordingly, not available to service other spinning stations at the same time that the yarn restart apparatus is restoring the one spinning station to its spinning operation. The capacity of such a combination apparatus to execute package changing operations is especially limited if the package changing component thereof includes an apparatus for preparing yarn end of the finished package which thereby extends the cycle time for the package changing operation. In this event, it is especially necessary to provide several combination package changing and yarn restarting units for a single open end spinning machine with a corresponding expense and complication.

Also known are systems having a higher package changing capacity by having the package changing apparatus and the yarn restarting apparatus independently movable for independently servicing the spinning stations. The package changing unit of this type of system carries the empty tubes for the package changing operation itself and these tubes have previously been provided with a start-up length of yarn for piecing with new yarn in the spinning element to start the spinning and winding onto the tube. As can be understood, once a so-called starter tube has been disposed on the creel of a spinning station, the yarn restarting operation proceeds in the same manner as if a yarn break had occurred at the spinning station. These types of systems have been used to accomplish batch changings. However, this type of system requires the expense and complication of prior processing of tubes to provide the start-up end.

Accordingly, the need exists for a package changing and a yarn restarting arrangement for a spinning machine which maximizes efficient use of each operation for performing its particular function at the spinning machine.

SUMMARY OF THE INVENTION

By the present invention a versatile and efficient system is provided for reestablishing the spinning operation at a spinning station at an open end spinning machine after either a yarn break or a package change with a minimum of production interruption by independent package changing operations and spinning restarting operations and with the spinning restarting operation being capable of restarting with a broken yarn end after a yarn break or restarting with an auxiliary yarn end after a package changing operation.

Briefly described, the present invention provides a method for establishing the spinning operation at a spinning station of an open end spinning machine of the type having a plurality of spinning stations with a spinning element at each station, having means for removing a full yarn package at a spinning station and placing an empty tube in position for winding spun yarn thereon, and having a traveling yarn restarting unit with a supply of auxiliary yarn thereon. The method includes generating at each spinning station a signal responsive to a yarn break thereat, generating at each spinning station a signal responsive to a package changing operation thereat, positioning the traveling yarn restarting unit at a spinning station in response to either of the signals, and operating the positioned yarn restarting unit to selectively either engage a broken yarn end from the yarn package in response to a yarn break signal, guide the yarn end to the spinning element to piece the yarn end with fibers and withdraw the pieced yarn from the spinning element, and restarting winding of the pieced yarn onto the yarn package, or provide a yarn end from an auxiliary yarn package in response to a package changing signal, guide the yarn end to the spinning element to piece the yarn end with fibers and withdrawing the pieced yarn from the spinning element, and engage the pieced yarn into an empty tube at the station.

Efficiently, the same guiding, piecing and withdrawing are used when practicing the method on a broken yarn end and on an auxiliary yarn end.

The generating of the signal response to a package changing operation is preferably generated in response to completion of removal of a full package and placing of an empty tube in position for winding yarn thereon, or by being response to the presence of an empty tube in position for winding.

In the preferred embodiment, the package changing operation is performed by a traveling yarn package changing unit, which generates a signal upon completion of its operation, which signal is responded to by the aforementioned positioning of the traveling yarn restarting unit.

In one preferred embodiment, the spinning stations are provided with counter mechanisms to indicate the length of yarn wound on the packages and the package changing operation signal is a signal response to the counter mechanism indicating that no yarn has been wound, which is the condition when an empty tube is in place for restarting winding.

Also in the preferred embodiment, a signal is generated in response to completion of winding of a full package and the positioning of the traveling yarn restarting unit is responsive to any of the yarn break, package changing operation or winding completion signals, and the operating of the positioned yarn restarting unit is responsive to either the yarn break signal or the package changing signal.

The apparatus of the present invention provides the means for carrying out the above described method and results in the aforementioned advantages.

Further features and advantages of the present invention will be apparent from the accompanying drawings and the following detailed description.

DETAILED DESCRIPTION OF THE PREFERRED EMBODIMENTS

Figure 1:
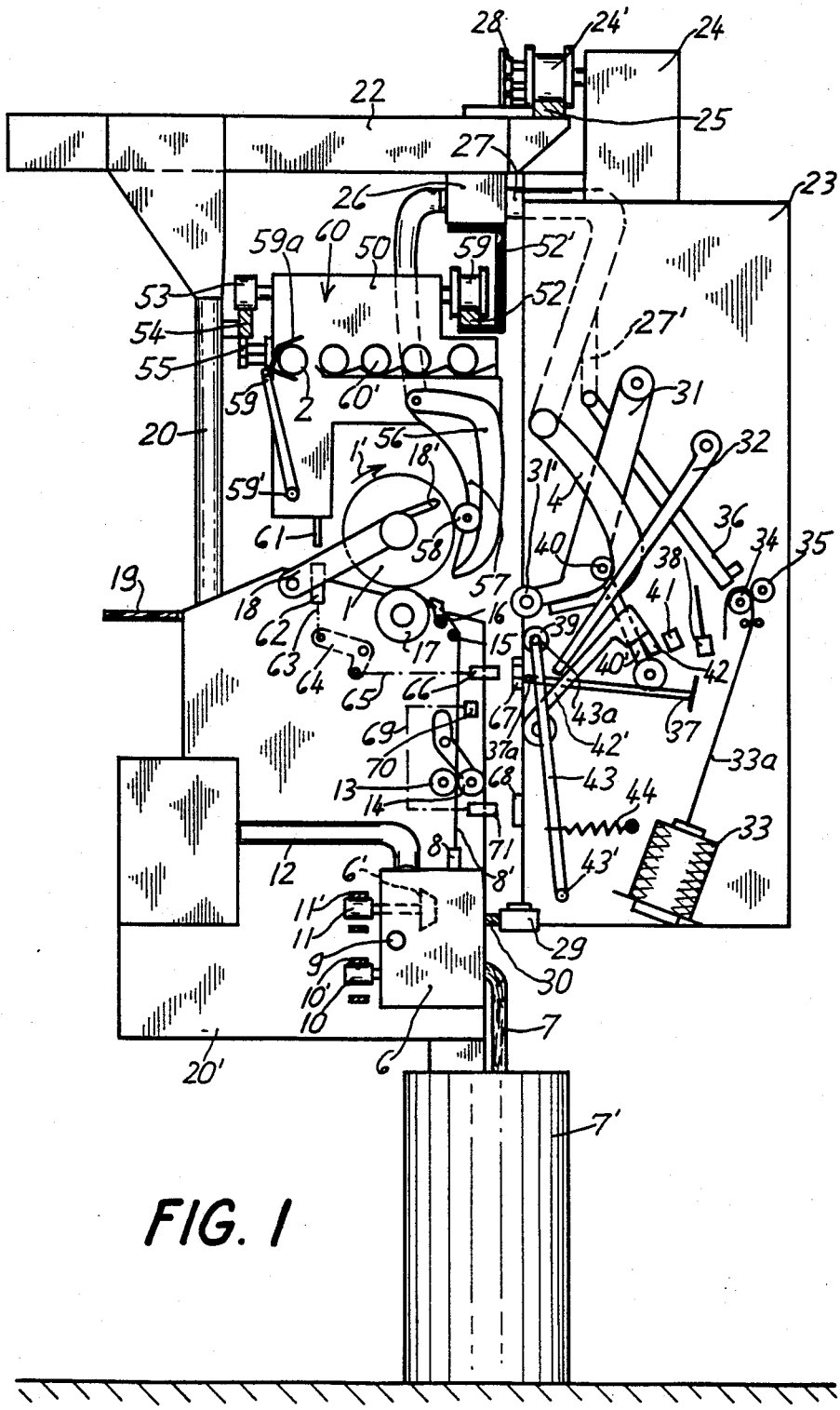
FIG. 1 is a side elevation of a spinning station of a spinning station at which the apparatus of one preferred embodiment of the present invention is located, including a traveling package changing unit and a separate traveling yarn restarting unit, both positioned for servicing the spinning station.

In FIG. 1, one preferred embodiment of the method and apparatus of the present invention is illustrated. It is incorporated in an otherwise conventional spinning station of a multiple station open end spinning machine wherein spin box 6 houses a rotating spinning element, such as, for example, a rotor 6', that draws silver 7 from a silver can 7' and, by means of a known open end spinning process, produces a yarn 8' therefrom. The yarn 8' is drawn out of the spinning box 6 by a take off tube 8. A feed apparatus 9 mounted to the spin box 6 continually draws the silver 7 into the spin box where it is caused to separate into individual fibers by a separating apparatus (not shown) which is driven by a drive assembly 10. The rotor 6' is driven by a rotor drive assembly 11. The rotor 6' collects the separated individual fibers and re-combines them to form the yarn 8'. Instead of a rotor, another suitable spinning element for spinning the yarn 8' can be used, such as, for example, friction rollers. The drive assembly 10 is driven by an endless belt 10' and the drive assembly 11 is driven by an endless belt 11'. A vacuum source 12 is connected to the spin box 6 and, in known manner, draws air out of the spin box to produce air conditions within the spin box which facilitate the forming of yarn therein. The yarn 8' is drawn at a substantially constant speed from the spin box 6 by means of a draw-off roller 13 cooperating with a spring-biased counter roller 14. The yarn 8' thereafter is trained around a directional roller 15 as it travels to a yarn guide apparatus 16 located closely adjacent a yarn package 1 and cooperating with the package to cross-wind the yarn 8' onto the package as the package rotates in the direction indicated by the arrow 1'. The package 1 is rotatably supported in a creel 18 and is rotatably driven by a friction winding drum 17.

Once the package 1 reaches its desired mass, desired winding length or desired size, the yarn feeding thereon is automatically broken and the spinning station at which the package 1 is being built is taken out of operation. The finished package 1 is then moved by the creel 18 to a position overlying a package transport belt 19, whereupon the finished package is transferred from the creel 18 to the package transport belt 19.

At the spinning station, a plurality of supports 20 support a rail frame 22, which supports a rail 25 extending along the periphery of the open end spinning machine to provide a transport rail for a traveling automatic, yarn restarting or piecing unit 23.

The piecing unit 23 includes a drive assembly 24 having a plurality of rollers 24' which are rotatably supported on the rail 25. A suction chamber 26 adjacent the rail 25 cooperates with a vacuum conduit 27 of the piecing unit 23 to supply a source of vacuum to the piecing unit 23. A plurality of electrical current carrying rails 28 disposed adjacent the rail 25 provide the piecing unit 23 with electrical power. A support roller 29 is mounted on the lower portion of the piecing unit 23 and rolls along a side support rail 30 extending along the spin boxes 6 of the spinning stations.

Figure 2:
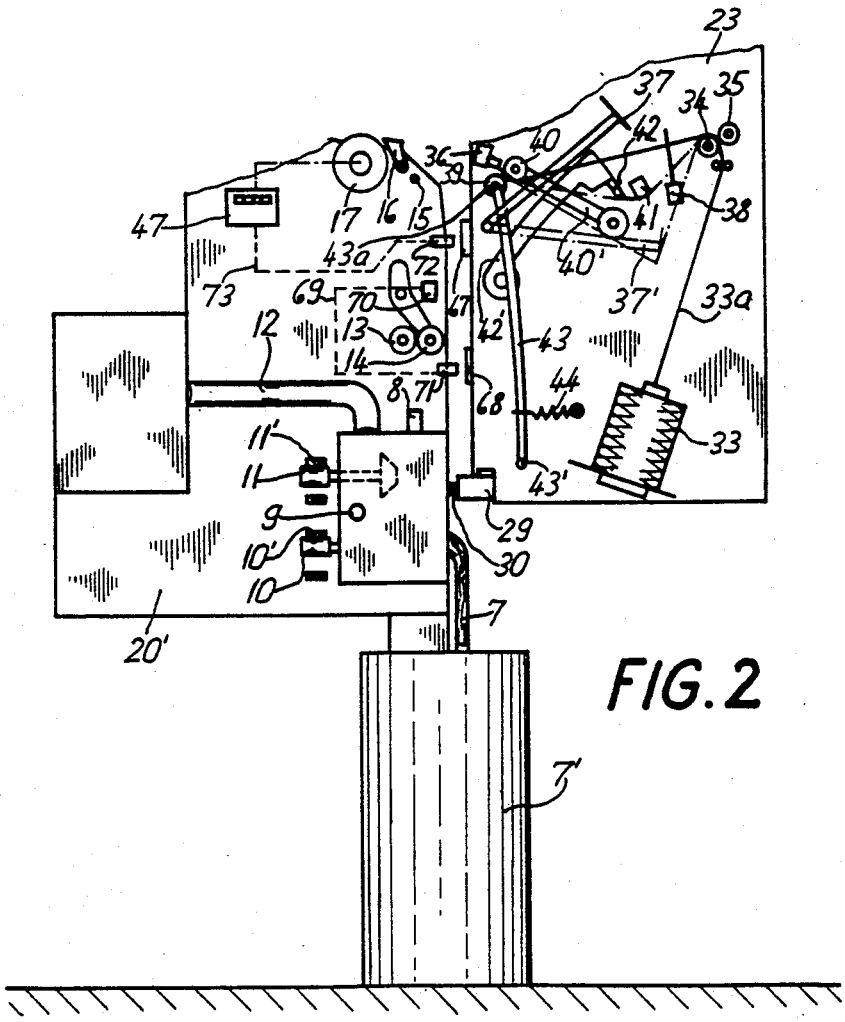
FIG. 2 is a side elevation of a portion of the apparatus of FIG. 1 after a package changing operation has been performed.
Figure 3:
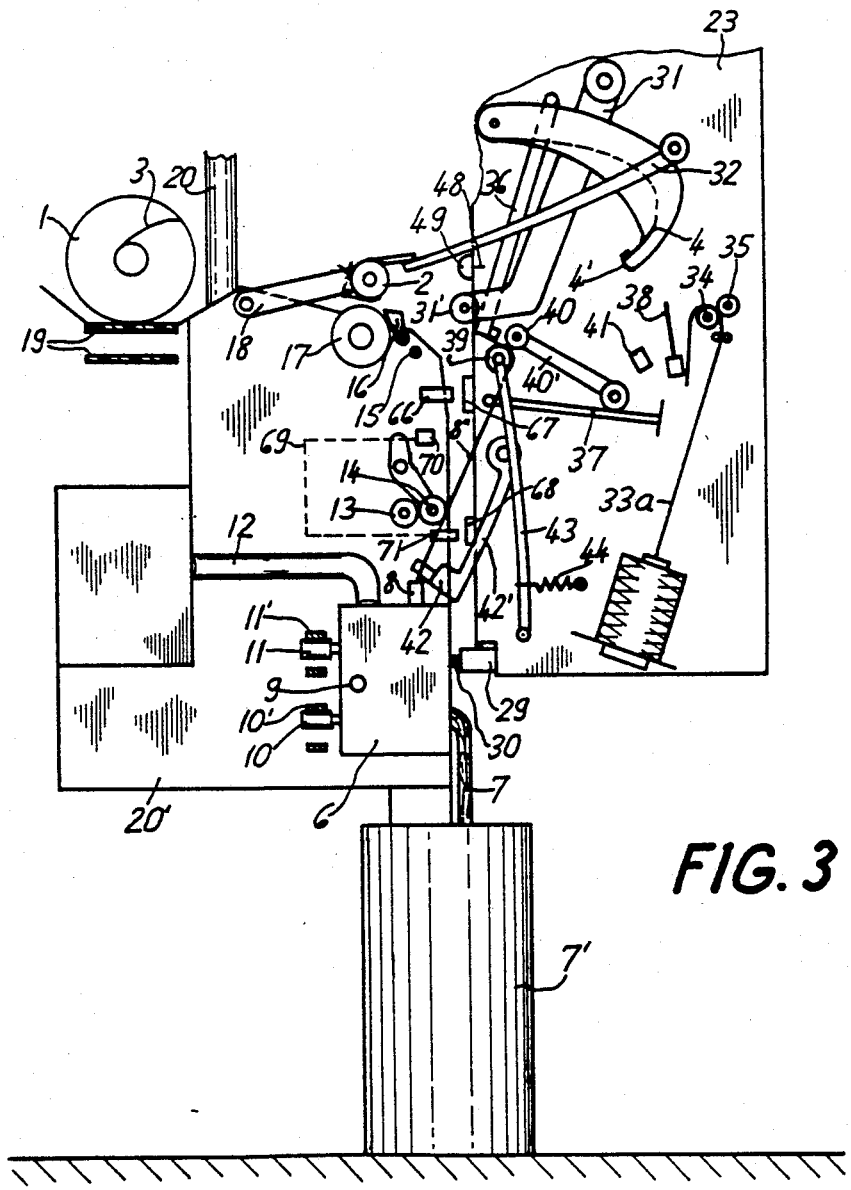
FIG. 3 is a view similar to FIG. 2 showing the yarn restarting operation being initiated.
Figure 4:
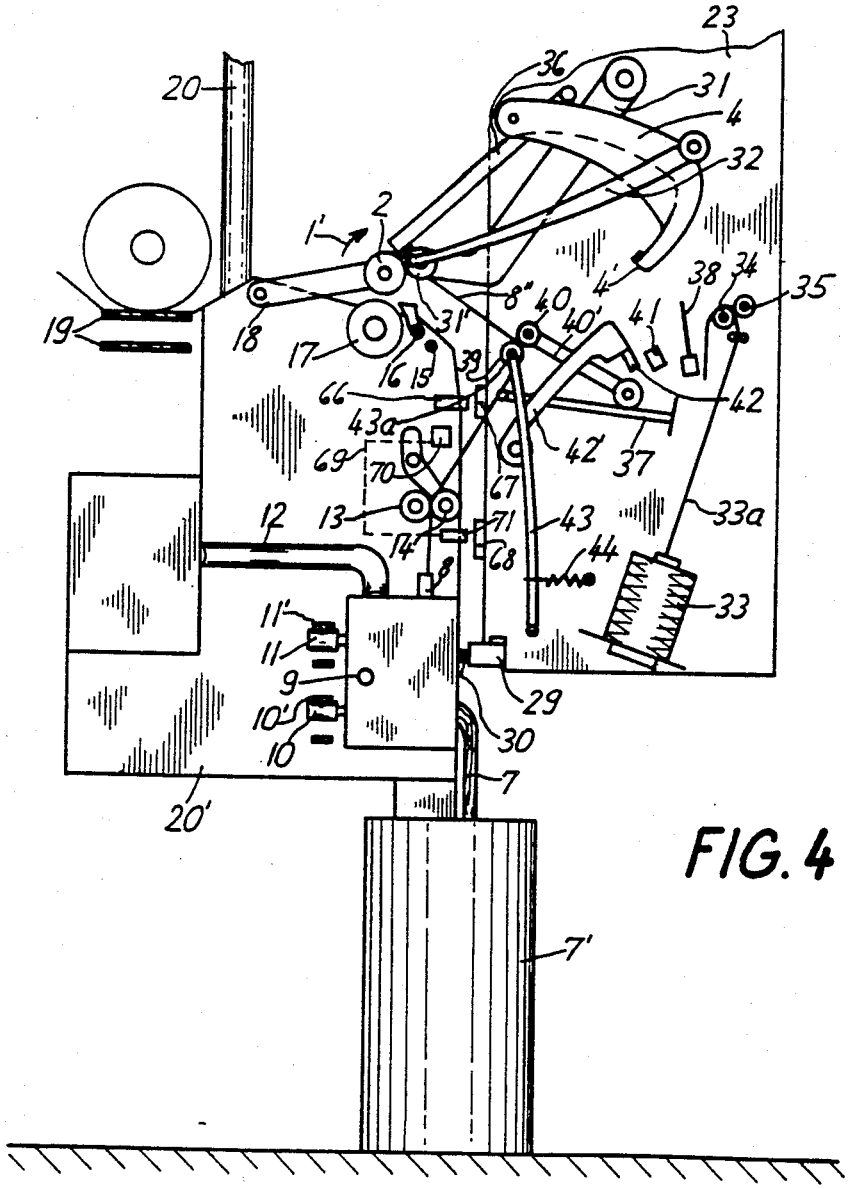
FIG. 4 is a view similar to FIG. 3 showing the yarn restarting operation being completed.
Figure 5:
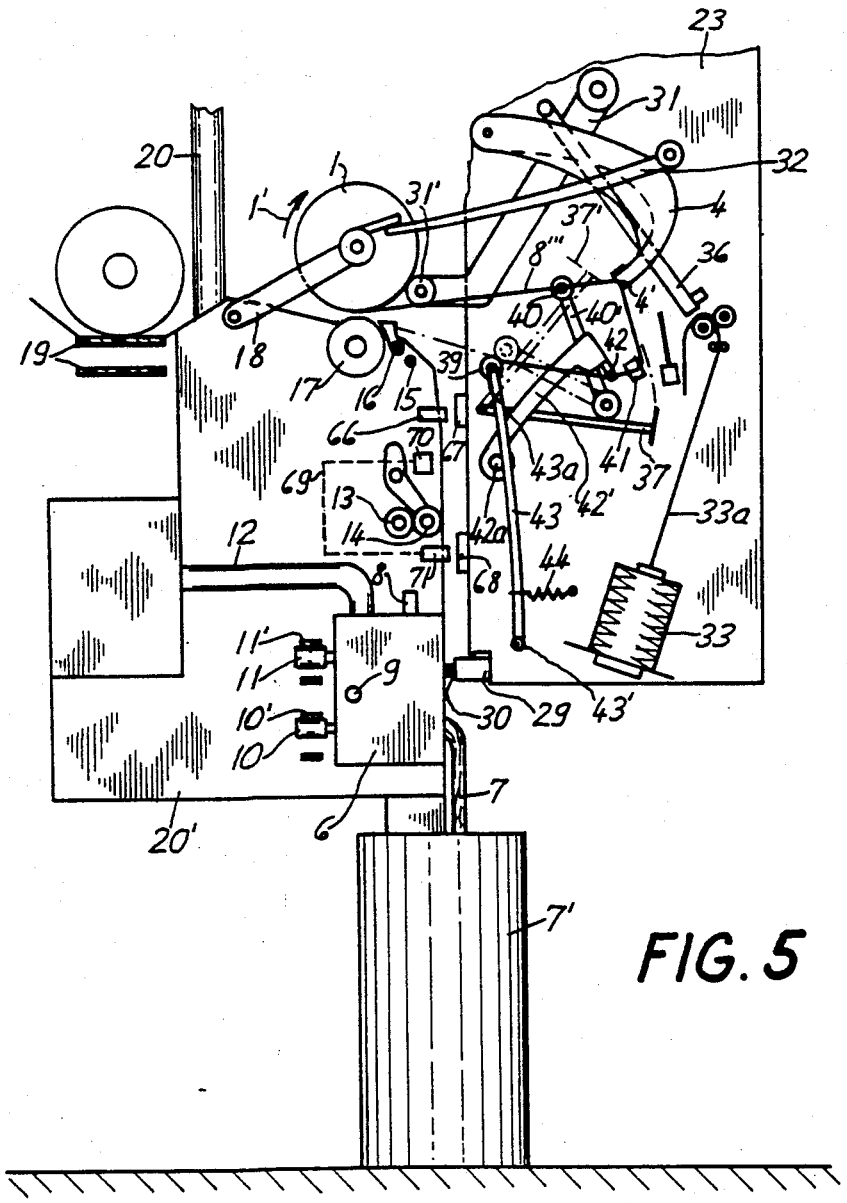
FIG. 5 is a side elevation of a portion of the apparatus of FIG. 1 operating to restart spinning after a yarn break.

The piecing unit 23 includes a first piecing program and an apparatus responsive to the first piecing program for piecing a portion 8''' of the yarn 8' extending from the package 1 (FIG. 5). Additionally, the piecing unit 23 includes a second piecing program and an apparatus responsive to the second piecing program for piecing an end of auxiliary yarn **33*a* extending from an auxiliary yarn package 33 (FIGS. 2, 3 and 4). The piecing unit 23** has means for starting the first piecing program in response to a yarn break or its results and means for starting the second piecing program in response to a package changing operation or its results.

To implement the first piecing program, a package driving apparatus 31 includes a rotating arm rotatably mounted to the piecing unit 23 and having a drive roller 31' rotatably mounted at its free end. The sequential implementation of the steps of the first piecing program can be accomplished by a conventional sequence controlling apparatus having a set of cam disks. The drive roller 31' is rotatably driven by a dedicated motor by which it can be rotated in clockwise and counter clockwise directions. An elongate frame lifter 32 is rotatably mounted on the housing of the unit and cooperates with a finger 18' of the creel 18 to thereby raise and lower the creel 18. The frame lifter 32 is also movable in a sidewise direction to selectively open and close the left-hand arm of the creel 18.

The second piecing program can be implemented by a conventional sequence controlling apparatus having a set of cam disks. In response to predetermined movements of the sequence controlling apparatus, various components of the piecing unit 23 are operated to execute the second piecing program. For this purpose, the auxiliary yarn package 23 is rotatably supported on the housing of the piecing unit 23 and delivers the auxiliary yarn 33*a* for a piecing operation following a package changing operation. The auxiliary yarn 33*a* is compressively engaged by a feed roller 34 and a counter roller 35. A feeder arm 36 communicates via a branch conduit 27' with the vacuum connection 27 and is rotatably mounted to the housing of the piecing unit 23. The feeder arm 36 supplies a suction to the auxiliary yarn 33*a* after its passage between the rollers 34, 35 to thereby engage the auxiliary yarn 33*a* and feed it to the vicinity of a draw-off roller 39 which functions during the piecing operation. The feeder arm 36 has a range of motions such that it can move the engaged auxiliary yarn 33*a* to a position behind the tube receiving spindle of the creel 18, at which position the engaged auxiliary yarn 33*a* can be engaged by the tube plate, and, for example, be gripped between the tube plate and the tube.

The auxiliary yarn 33*a* can be held against the draw-off roller 39 by a counter roller 40. A draw-down device 37 is rotatably mounted on a pivot arm 37*a* to the piecing unit 23 and operates to pull the auxiliary yarn 33*a* downwardly to a cutting and untwisting device 41 and a yarn transfer member 42.

A guide lever 38 functions to engage and transfer the auxiliary yarn 33*a* to the draw-down device 37. For this purpose, the guide lever 38 has a range of motion from the back side toward the middle of the piecing unit 23.

The cutting and untwisting device 41 operates to cut the yarn disposed therein and to prepare the end of the yarn for piecing. The yarn end preparation is accomplished, for example, by a pneumatic untwisting. The yarn transfer member 42 is pivotable to transfer the yarn end to the drawing tube 8. After the piecing operation or the positioning of the yarn in the tube supported on the creel 18, the yarn is guided downwardly by the draw-off roller 39 of the piecing unit 23 and returned to its normal running position at the spinning station by the operation of a transfer device 43 which pivots about a pivot point 43' against the bias of a spring 44 connected thereto. The transfer device 43 supports, on its free end, a small roller 43*a* which is, in the position shown in FIG. 1, coaxial with the draw-off roller 39. To transfer the yarn from the draw-off roller 39, the yarn is pushed in a sidewise direction from the draw-off roller 39 onto the small roller 43*a* while the winding speed of the package 1 is simultaneously somewhat increased. In response to the increased winding speed, the transfer device 43 moves against the bias of the spring 44 and in the direction of the spinning station. In this manner, a yarn loop between the spinning station and the piecing unit 23 is taken up.

To restart spinning after a yarn break, a suction device 4 pivots into contact with the package 1 and applies a suction force through its mouth 4' to locate and engage the broken end of yarn on the package. Once the yarn is engaged, the suction device 4 pivots back an extent sufficient to allow the draw-down device 37 to pivot adjacent the mouth 4' of the suction device 4 and thereat engage the yarn, as shown in FIG. 5, and deliver it to the cutting and untwisting device 41 and the yarn transfer member 42 for executing the piecing operation described above for the auxiliary yarn end 33*a*.

Thus, both the broken yarn end from the package and the auxiliary yarn end are similarly positioned for piecing so that efficiently the same components and method are used for guiding the yarn end to the spinning element for piecing and withdrawing as pieced yarn from the spinning element during both restarting after a yarn break or after a package change.

A package changing unit 50, which can be of the type disclosed in U.S. Pat. No. 4,736,898, travels along and is supported on a rail 52. A drive means 59 including a drive roller drives the package changing unit 50 along the rail 52. The rail 52 is mounted on the underside of the suction chamber 26 by a plurality of brackets 52'. The package changing unit 50 also includes a plurality of support rollers 53 which roll along a second rail 54 mounted to the supports 20. A plurality of electrical current carrying rails 55 are mounted to the underside of the rail 54 for supplying electric current to the unit 50.

As described in more detail in U.S. Pat. No. 4,736,898, a reserve winding of yarn is formed on a fully wound package before it is removed from the spinning station. This is performed by a suction device 56 that locates and engages the end of yarn on the finished package 1. For this purpose, the creel 18 is raised, by means of the frame lifter 32, by a sufficient amount so that the package 1 is moved out of contact with the drum 17. To facilitate the location of the end of yarn on the package 1, the package 1 is rotated in a direction opposite to the direction of rotation for winding by a package driving roller 58 mounted on the suction device 56. Once the yarn on the package 1 is located and has been engaged by the suction device 56, the package driving roller 58 reverses its direction of rotation and drives the package 1 in the direction of rotation of winding, whereby the yarn is guided to the side by a guide channel 57 on the suction device 56 which is inclined traversely with respect to the package 1. In this manner, the yarn is wound into a yarn reserve on the end of the tube of the package 1.

The suction device 56 additionally operates to doff the finished package 1 from the creel 18. In this regard, the creel 18 is opened by the package changing unit 50 and the suction device 56 is pivoted in a clockwise direction, thereby contacting and pushing the finished package 1 in the direction of the package transport belt 19.

To place an empty tube in position for restarting the winding of yarn thereon, the package changing unit 50 includes a tube inserter 59 which is pivotally mounted to the assembly at a pivot point 59'. The tube inserter 59 includes a tube gripper 59*a* which retrieves one of the tubes 60' stored in a tube magazine 60 mounted on the unit 50. As shown in FIG. 1, the tube gripper 59 one of the tubes stored in the tube magazine 60, namely, a tube 2. The tube inserter 59 pivots in a clockwise direction about the pivot point 59' to position the new tube 2 in a position for installation onto the creel 18 after the finished package 1 has been removed from the creel 18.

The piecing unit 23 includes means for initiating the second piecing program in correspondence with the package changing operation. The initiating means includes a sensor 67 which monitors a demand pin 66 mounted to the frame 20' of the spinning station. A signal transmitter 61 of the package changing unit 50 presses on an initiating pin 62 after the conclusion of the package changing operation. A signal indicating movement of the initiating pin 62 in response to being pressed is transmitted via a coupling 63, a link 64 and an additional coupling 65 to the demand pin 66 which pops or moves outwardly in response to the signal. The sensor 67 is mounted on the piecing unit 23 and is programmed to recognize, when it is aligned with it, that the demand pin 66 has moved into its outward position, signaling the piecing unit 23 to stop in response to its recognition of the demand pin 66. Additionally, the sensor 67 initiates the second piecing program which will now be further described.

The signal transmitter 61 includes a switch coupled to a control apparatus (not shown) of the package changing unit 50. The control apparatus actuates the switch as soon as the package changing is completed. The initiating pin 62, the coupling 63, the link 64 and the additional coupling 65 operatively connect the signal transmitter 61 to the demand pin 66 so that demand pin 66 responds to the signal from the signal transmitter 61 and moves to an outwardly projecting disposition.

The piecing unit 23 additionally includes means for initiating the first piecing program in response to a yarn break. In accordance with the first piecing program, the end of the yarn on the package 1 is transferred to the spin box 6. The initiating means includes a sensor 68 which monitors a second demand pin 71 mounted on the machine frame 20'. The second demand pin 71 is connected through a connector 69 which can be, for example, an electronic connector, with a yarn monitor 70. In the event of a yarn break, current travels through the connector 69 to activate the second demand pin 71, thereby causing the pin to move outwardly. The sensor 68, which is mounted on the piecing unit 23, recognizes that the second demand pin 71 has moved outwardly and signals the piecing unit 23 to stop at the spinning station. Thereafter, the sensor 68 initiates the first piecing program.

In FIG. 1, the various components are shown in the position they are in at the end of a normal spinning operation. The piecing unit 23 thereafter eventually stops in its service position adjacent the spinning station. Additionally, the package changing unit 50 has moved into its position for servicing the spinning station and stands ready to insert a new tube onto the creel 18 following the doffing therefrom of the finished package 1.

Once the desired yarn length, volume or diameter of the package 1 has been achieved, the spinning process has automatically been interrupted and the package changing unit 50 is signaled, in known manner. The operation can also be configured so that the package changing unit 50 is positioned at the spinning station by a bar extending from the spinning station contacting a cooperating member of the package changing unit 50 which signals the unit 50 to begin its operation. Upon the completion of the package changing operation, the unit 50 moves from its service position, whereupon the sensor 62, which monitors the signal transmitter 61 of the unit 50, transmits a signal to the demand pin 66 which, in turn, moves outwardly in response to the signal. Thereafter, the sensor 67 of the piecing unit 23 recognizes that the demand pin 66 is in its outward position and, accordingly, transmits a signal to the piecing unit 23 to assume its position for servicing the spinning station. In the event that the piecing unit 23 is already in its service position, the signal from the sensor 67 is interpreted as a signal to immediately commence the second piecing program.

The feeder arm 36 then engages the auxiliary yarn 33*a*, which is disposed on the feed roller 34, by applying suction thereto. The engaged auxiliary yarn 33*a* is then swung by the feeder arm 36 into the position shown in FIG. 2, in which the auxiliary yarn is transferred to the draw-off roller 39. The clamping roller 40 is then moved into engagement with the draw-off roller 39 to compressively secure the auxiliary yarn 33*a* therebetween. Thereafter, the guide lever 38 presses on the auxiliary yarn 33*a* to facilitate the engagement of the auxiliary yarn by the draw-down device 37. As the draw-down device 37 is downwardly pivoted, the auxiliary yarn 33*a* is engaged and is drawn downwardly, as shown in FIG. 2. During this action, the feed roller 34 permits the auxiliary yarn 33*a* to unwind, as necessary, from the auxiliary package 33. During the downward movement of the auxiliary yarn 33*a* under the action of the draw-down device 37, the auxiliary yarn is moved past the yarn transfer member 42 and the cutting and untwisting device 41. After reaching the position 37' at the completion of its downward pivoting, the draw-down device 37 reverses its pivoting direction and pivots upwardly, while the clamping roller 40 is opened slightly so that the auxiliary yarn 33*a* is held under tension by the suction action of the feeder arm 36.

Thereafter, the auxiliary yarn 33*a* is positioned in the clamping members of the yarn transfer member 42 and the cutting and untwisting device 41, as shown in FIG. 2. The auxiliary yarn 33*a* is thereafter cut and the new yarn end occurring therefrom is untwisted by the cutting and untwisting device 41 in preparation for piecing with newly spun yarn in the spin box 6.

The transfer device 42 then pivots in a clockwise direction until it reaches the position shown in FIG. 3, whereby the end of the auxiliary yarn 33*a* is released to be pneumatically drawn by the draw-off tube 8 into the spin box 6. Once inside the spin box 6 and adjacent the spin element 6', the yarn end of the segment of the auxiliary yarn 33*a* is connected with the yarn within the spin element 6' following the activation of the initiating apparatus 9 to again resume the spinning process in the spin element 6'.

In FIG. 3, the piecing unit 23 is shown in a position in which the tube 2 is engaged by the creel 18. The transfer device 42 has been swung against the draw-off tube 8 of the spin box 6 and has, as described just above, delivered the yarn end of the auxiliary yarn 33*a* to the region adjacent the draw-off tube 8 in which the suction action of the tube can engage the yarn. The draw-off roller 39 has pushed the auxiliary yarn 33*a* in a direction away from the spin box 6. The point in time at which the piecing operation occurs has just passed and the end of the auxiliary yarn 33*a* has been pieced with the newly spun yarn within the spin box 6. Thereafter, the draw-off roller 39 draws the auxiliary yarn 33*a*, and the yarn 8'' pieced thereto, at a constant velocity out of the spin box 6. The yarn 8'' is then drawn into the feeder arm 36 by application of a suction thereto.

In FIG. 4, the position of the piecing unit 23 during the period in which the yarn 8'' is disposed on the tube 2 is illustrated. The frame lifter 32 maintains the creel 18 at a sufficient height so that the tube 2 is out of contact with the friction drum 17. In this raised position, the tube 2 is drivingly rotated by the drive roller 31' in the direction shown by the arrow 1', that is, in the winding direction. The feeder arm 36 which has engaged the yarn 8'' by suction action is pivoted to move past the rearmost tube plate of the creel 18. In this manner, the yarn 8'' is in the position in which it can be engaged, in known manner, by gripping slots in the tube plate. After the yarn 8'' has been gripped by the tube plate and has begun to be wound onto the tube 2, the yarn is severed from the auxiliary yarn 33a by a cutting apparatus (not shown) secured to the feeder arm 36 in the region of the opening of its vacuum conduit. The severed end of the yarn 8'' is then removed by suction. The feeder arm 36 can be provided with a contoured surface on its end for guiding the yarn onto the tube to build a beginning reserve of yarn thereon in a known manner. Then, the yarn 8'' is pushed by the draw-down roller 39 and transferred to the roller 43a of the transfer device 43. The frame lifter 32 then releases the creel 18 which pivots downwardly, thereby bringing the tube 2 into engagement with the friction drum 17, and, simultaneously, the yarn 8'' is engaged by the yarn guide 16. During this transfer the winding speed is increased to take up the loop originally formed. The drive roller 31', which is now no longer needed, is shut down and withdrawn by reverse pivoting of the apparatus 31. At this point, the piecing operation in accordance with the second piecing program is completed. The piecing unit 23 is now in a position to leave its service position at the spinning station and move to another service position for servicing another spinning station.

If a yarn break during spinning occurs, the operation of the apparatus of the present invention is controlled in accordance with the first piecing program. The yarn monitor 70 detects the occurence of the yarn break and causes the demand pin 71 to be ejected outward. The sensor 68 detects the outward position of the demand pin 71 and signals the piecing unit 23 to halt in its service position relative to the spinning station at which the yarn break has occurred. Thereafter, the first piecing program is initiated.

In FIG. 5, the piecing unit 23 is shown during the preparations for the piecing of the yarn following a yarn break. The frame lifter 32 has engaged the creel 18 and lifted the package 1 out of engagement with the friction roller 17. The drive roller 31' of the apparatus 31 has engaged the package 1. The suction tube 4 has previously engaged the package 1 in order to locate and engage the yarn end by suction. At the point during the piecing operation illustrated in FIG. 5, the suction tube 4 has already pivoted away from the package 1 while holding the yarn 8'''. The draw-down device 37 has been swung to its upper position shown in the dot-dash line in FIG. 5, during which movement it passed the yarn 8'''. Thereafter, it is pivoted downwardly from its upper position and engages the yarn 8'''. In this manner, the yarn 8''' is drawn out into a loop, as shown in FIG. 5, and is disposed on the draw-off roller 39. Thereafter, the clamping roller 40, through pivoting movement of its arm 40', is disposed against the draw-off roller 39 in the position shown by the dot-dash lines in FIG. 5. Subsequently, the draw-down device 37 is pivoted to its upper position and the yarn loop slides into the yarn transfer member 42 and into the cutting and untwisting device 41. The yarn 8''' is now cut and the new yarn end is prepared for piecing, including untwisting, as described with respect to the second piecing program. The transfer arm 42' of the transfer device 42 now swings in a clockwise direction about its pivot point 42a, engages yarn 8'' and transfers the new yarn end to the take off tube 8 where it is drawn into the spin box 6.

The piecing operation is now occurring in the same manner as discussed with respect to the second piecing program. After the yarn end of the yarn 8''' has been pieced with the yarn in the spin box 6, the yarn is drawn out of the spin box by the action of the draw-off roller 39 and, through the action of the transfer device 43, the yarn is guided onto the package 1 for winding thereon, which is drivingly rotated under the action of the drive roller 31'. Transfer of the yarn to the package is accomplished in the manner discussed above with respect to the second piecing.

As shown in FIG. 3, the piecing unit 23 includes a signal transmitter 49 which monitors the creel 18 to detect the presence of an empty tube 2 thereon. The signal transmitter 49 is connected by a connector 48 to the sensor 67. When the signal transmitter 49 detects the presence of an empty tube 2 disposed on the creel 18, a signal is transmitted to the switch means 67, which thereby directs the piecing unit 23 to assume its service position at the spinning station and to begin the second spinning program.

The signal to the piecing unit to assume its service position and to begin the second piecing program can, for example, be generated in response to the receipt of an empty tube at a spinning station either from the package changing unit 50 or from the spinning station and the signal can be transmitted further to a central computer of the open end spinning machine, which central computer further transmits this signal, along with an identification signal, to the piecing unit 23, which can thereafter proceed to the spinning station requiring servicing.

The signal transmission between the open end spinning machine, the spinning station, the package changing unit and the piecing unit can be accomplished through optical or electromagnetic signals, through variable electrical or magnetic fields or in a similar manner. The signals can be transferred through contact mechanisms such as, for example, electromagnetic switches.

As shown in FIG. 2, the spinning station can include a yarn length counter mechanism 47, which determines the length of the yarn wound on the package 1 by, for example, counting the number of rotations of the friction drum 17. Once the predetermined yarn length has been reached, the yarn length counter mechanism 47 can, for example, automatically reset itself to zero and signal the package changing unit 50 to proceed to the spinning station to execute a package changing operation thereat. Simultaneously, the counter mechanism 47, through a connector 73, activates a demand pin 72 to move to its outward position, whereby the sensor 67 of the piecing unit 23 passing thereby detects the outward position of the demand pin 72 and signals the piecing unit to assume its service position at the spinning station and to selectively implement its piecing program. The decision to start the selected piecing program immediately following the selection thereof is dependent upon whether a package change has occurred since the selection of the piecing program. The piecing program can begin either after the expiration of a predetermined time period or can be initiated upon the receipt of a signal sent by one of the signal transmitters as described above.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for reestablishing the spinning operation at a spinning station of an open end spinning machine of the type having a plurality of spinning stations with a spinning element at each station, having a traveling package changing unit for removing a full yarn package at a spinning station and placing an empty tube in position for winding spun yarn therein, and having a traveling yarn restarting unit with a supply of auxiliary yarn thereon, the traveling package changing unit and the traveling yarn restarting unit being independently movable, comprising:

generating at each spinning station a signal responsive to a yarn break thereat;

generating at each spinning station a signal responsive to the completion of a package changing operation thereat by the traveling package changing unit;

positioning said traveling yarn restarting unit at a spinning station in response to either of said signals being generated thereat; and operating said positioned yarn restarting unit to selectively either engage a broken yarn end from the yarn package in response to a yarn break signal, guide the yarn end to the spinning element to piece the yarn end with fibers and withdraw the pieced yarn from the spinning element, and restarting winding of the pieced yarn onto the yarn package, or provide a yarn end from an auxiliary yarn package in response to a package changing signal to guide the yarn end to the spinning element to piece the yarn end with fibers and withdraw the pieced yarn from the spinning element, and engage the pieced yarn onto an empty tube at said station.

2. A method for restarting the spinning operation at a spinning station according to claim 1 and characterized further in that the guide of the yarn end to the spinning element to piece the yarn end with fibers and withdraw the pieced yarn from the spinning element is the same for a broken yarn end and for an auxiliary yarn end.

3. A method for restarting the spinning operation at a spinning station according to claim 1 and characterized further in that said generating a signal responsive to a package changing operation is generated in response to completion of removal of a full package and placing of an empty tube in position for winding yarn thereon.

4. A method for restarting the spinning operation at a spinning station according to claim 1 wherein said spinning machine includes a traveling yarn package changing unit for removing full packages at the spinning stations and placing empty tubes for winding yarn thereon, said method being characterized further in that said generating a signal responsive to a package changing operation is generated in response to completion of operation of said package changing unit.

5. A method for restarting the spinning operation at a spinning station according to claim 1 wherein a counter mechanism indicates the length of yarn wound on the package, said method being characterized further in that said generating a signal responsive to a package changing operation generates a signal responsive to the counter mechanism indicating that no yarn has been wound.

6. A method for restarting the spinning operation at a spinning station according to claim 1 wherein a counter mechanism indicates the length of yarn wound on the package, said method being characterized further in that said generating a signal responsive to a package changing operation generates a signal responsive to the counter mechanism indicating that no yarn has been wound and responsive to the presence of an empty tube in position for winding yarn thereon.

7. A method for restarting the spinning operation at a spinning station according to claim 1 and characterized further in that said generating a signal responsive to a package changing operation is responsive to the presence of an empty tube in position for winding yarn thereon at the spinning station.

8. A method for restarting the spinning operation at a spinning station according to claims 1, 3, 5, 6 or 7 and characterized further by generating at each spinning station a signal responsive to completion of winding of a full package and in that said positioning of said traveling yarn restarting unit is responsive to any of said signals and said operating of said positioned yarn restarting unit is responsive to either said yarn break signal or said package changing signal.

9. An apparatus for reestablishing the spinning operation at a spinning station of an open end spinning machine of the type having a plurality of spinning stations with a spinning element at each station, comprising:

a traveling package changing unit for removing a full yarn package at a spinning station and placing an empty tube in position for winding spun yarn thereon;

a traveling yarn restarting unit having a supply of auxiliary yarn, said traveling package changing unit and said traveling yarn restarting unit being movable independently of one another;

means for generating at each spinning station a signal responsive to a yarn break thereat;

means for generating at each spinning station a signal responsive to a package changing operation thereat by said traveling package changing unit;

means for positioning said traveling yarn restarting unit at a spinning station in response to either of said signals being generated thereat; and means for operating said positioned yarn restarting unit to selectively either engage a broken yarn end from the yarn package in response to a yarn break signal, guide the yarn end to the spinning element to piece the yarn end with fibers and withdraw the pieced yarn from the spinning element, and restart the winding of the pieced yarn onto the yarn package or provide a yarn end from an auxiliary yarn package in response to a package changing signal to guide the yarn end to the spinning element to piece the yarn end with fibers and withdraw the pieced yarn from the spinning element, and engage the pieced yarn onto an empty tube at said station.

10. An apparatus for restarting the spinning operation at a spinning station according to claim 9 and characterized further in that said operating means includes a guiding means that guides both a broken yarn end and an auxiliary yarn end to the spinning element to piece the yarn end with fibers and withdraw the pieced yarn from the spinning element.

11. An apparatus for restarting the spinning operation at a spinning station according to claim 9 and characterized further in that said means for generating a signal responsive to a package changing operation is responsive to completion of removal of a full package and placing of an empty tube in position for winding yarn thereon.

12. An apparatus for restarting the spinning operation at a spinning station according to claim 9 wherein a counter mechanism indicates the length of yarn wound on the package, said apparatus being characterized further in that said means for generating a signal responsive to a package changing operation generates a signal responsive to the counter mechanism indicating that no yarn has been wound.

13. An apparatus for restarting the spinning operation at a spinning station according to claim 9 wherein a counter mechanism indicates the length of yarn wound on the package, said apparatus being characterized further in that said means for generating a signal responsive to a package changing operation generates a signal responsive to the counter mechanism indicating that no yarn has been wound and responsive to the presence of an empty tube in position for winding yarn thereon.

14. An apparatus for restarting the spinning operation at a spinning station according to claim 9 and characterized further in that said means for generating a signal responsive to a package changing operation is responsive to the presence of an empty tube in position for winding yarn thereon at the spinning station.

15. An apparatus for restarting the spinning operation at a spinning station according to claim 14 and characterized further by sensing means mounted on said traveling yarn restarting unit for sensing the presence of an empty tube at a spinning station, and in that said means for generating a signal responsive to a package changing operation is responsive to said sensing means.

16. An apparatus for restarting the spinning operation at a spinning station according to claims 9, 11, 12, 13, or 14 and characterized further by means for generating at each spinning station a signal responsive to completion of winding of a full package and in that said means for positioning of said traveling yarn restarting unit is responsive to any of said signals and said means for operating of said positioned yarn restarting unit is responsive to either said yarn break signal or said package changing signal.

* * * * *